US005533656A

United States Patent [19]

Bonaldi

[11] Patent Number: 5,533,656

[45] Date of Patent: Jul. 9, 1996

[54] COMBINATION WALLET WITH REMOVEABLE CLIP

[76] Inventor: Jeffrey P. Bonaldi, 269 Monmouth Ave., New Milford, N.J. 07646

[21] Appl. No.: 313,448

[22] Filed: Sep. 27, 1994

[51] Int. Cl.[6] ..... A45F 5/02

[52] U.S. Cl. ..... 224/667; 224/269; 224/901; 224/668; 224/680; 224/901.6; 224/901.8

[58] Field of Search ..... 224/252, 269, 224/901; 150/118, 137, 143

[56] References Cited

U.S. PATENT DOCUMENTS

| | | | |
|---|---|---|---|
| 1,435,704 | 11/1922 | Fisher . | |
| 2,117,989 | 5/1938 | Ryan . | |
| 2,259,204 | 10/1941 | Fulton . | |
| 2,272,854 | 2/1942 | Sloane et al. . | |
| 2,595,843 | 5/1952 | Grabhorn | 150/137 |
| 4,226,105 | 10/1980 | Wehrman | 224/269 |
| 4,416,315 | 11/1983 | Foley . | |
| 4,444,342 | 4/1984 | Powell | 224/252 |
| 4,467,946 | 8/1984 | Brown | 224/252 |
| 4,705,086 | 11/1987 | O'Neill . | |
| 4,741,372 | 5/1988 | Santilli . | |
| 4,784,199 | 11/1988 | Wise . | |
| 4,821,934 | 4/1989 | Alessi et al. | 224/252 |
| 4,903,745 | 2/1990 | Roman . | |
| 4,915,215 | 4/1990 | Brekke | 224/252 |
| 5,103,884 | 4/1992 | Roman . | |
| 5,129,126 | 7/1992 | Huang | 224/252 |
| 5,255,835 | 10/1993 | Burks | 224/252 |
| 5,274,318 | 12/1993 | Nordberg et al. | 224/252 |
| 5,351,868 | 10/1994 | Beletsky et al. | 224/252 |
| 5,356,060 | 10/1994 | Kuroda | 224/252 |
| 5,381,922 | 1/1995 | Gladman et al. | 224/252 |
| 5,385,282 | 1/1995 | Chen | 224/252 |

FOREIGN PATENT DOCUMENTS

| | | | |
|---|---|---|---|
| 823409 | 11/1959 | United Kingdom | 224/252 |

OTHER PUBLICATIONS

Maguire Co., Inc. "Assorted Clips" Jun. 22, 1992.

*Primary Examiner*—Henry J. Recla
*Assistant Examiner*—Charles R. Eloshway
*Attorney, Agent, or Firm*—Weingram & Zall

[57] ABSTRACT

A clip is provided which is constructed to be removably mounted to a flexible pocket-like container, the clip consisting of a back portion having a stabilizing portion and a fastening portion, a front portion having a bend and a barb which is formed at a back side of the bend for facing the back portion to resist movement of fabric between the stabilizing portion and the barb, and a resilient transition connecting the back portion with the front portion to provide sufficient resilience to urge the bend portion and barb toward the back portion.

34 Claims, 4 Drawing Sheets

COMBINATION WALLET WITH REMOVEABLE CLIP

FIELD OF THE INVENTION

The present invention relates to a wallet device which can be removably mounted to clothing, and particularly, to those wallet devices which have a removable clip.

BACKGROUND OF THE INVENTION

Clip and hook assemblies are known to be used in the manufacture of handbags and wallets. The clips and hooks are employed to hold objects within these devices or to secure the devices to clothing.

For example, U.S. Pat. No. 1,435,704 to Fisher discloses a handbag provided with an interior pocket in which a watch is hung.

U.S. Pat. No. 2,117,989 to Ryan discloses a handbag key retainer which consists of a hook mounted to the inside of a handbag and which is supported by pins extending through the wall of the handbag from an ornament at the exterior thereof. The hook holds a key in the upper part of the handbag.

U.S. Pat. No. 2,259,204 to Fulton discloses a key hold for the inside of a handbag. The key hold consists of a plate mounted to the interior wall of the handbag from which depend hooks to receive keys.

U.S. Pat. No. 2,272,854 to Sloane et al. discloses a combined handbag and key holder having handbag frame members which are hingedly interconnected. A pin is secured in a hollow rivet disposed through one of the hinges. The pin has an end extending to the interior of the bag and from which a one-piece member with an upwardly bent tongue portion is disposed to engage a ring or chain element.

U.S. Pat. No. 4,416,315 To Foley discloses a device for carrying valuables which consists of a container having one end with an aperture therethrough, and a hanger support member movably mounted within the container and having an end which extends through the aperture to be connected to a flexible and resilient clip at the exterior of the container. The hanger and support member are movable between extended and retracted positions, i.e. in an extended position the clip may be positioned over a pants hemline, while in the retracted position the clip will engage an adjacent portion of a pocket of a coat. A snap-type connector at the interior of the container releasably connects a snap-type connector on the support member to maintain the support member in the retracted position.

U.S. Pat. No. 4,705,086 To O'Neill discloses a wallet for joggers which includes a detachable hook member, a portion of which is received in a slit opening in a panel of the wallet while an adjacent portion of the hook is detachably secured to the back panel of the wallet by velcro.

U.S. Pat. No. 4,741,372 To Santilli discloses a pocket organizer which includes a cover sheet wrapped around a plurality of envelopes which share a common seam and which are secured together along the seam by a clip. The clip has a C-shaped end portion and another leg portion adapted to be resiliently retained beneath the end of the C-shaped portion., A biased prong presses against the leg portion to confine the contents in the envelopes.

U.S. Pat. No. 4,784,199 To Wise discloses a wallet with a removable three-legged spring clip, the first leg inserted into the bottom of an exterior pocket on the wallet, the second leg spring-biased against the first leg to hold the clip onto the wallet, and the third leg spring-biased against the second leg to hold the wallet onto the wearer's waistband. Wise discloses the prior art to include a billfold with a clip having an inner leg stamped to form a pair of upward pointing barbs along its edges which is inserted into the pocket at the side of the billfold. The barbs catch on the wallet material inside the pocket to hold the clip in place. The outer leg is clipped over a wearer's waistband.

U.S. Pat. Nos. 4,903,745 and 5,103,884 to Roman each disclose a wallet with a removable clip wherein the wallet includes a patch secured to the outside surface of the wallet. Slots are provided at each end of a pocket formed by the patch. A backplate of the clip is removably inserted into the pocket through the slots.

Among these devices, there is no disclosure of a clip constructed to be removably mounted to a flexible pocket- or pouch-like container, the clip constructed with a front portion having a barb to engage the fabric of a wearer's garment and to resist movement of the fabric when it is engaged between the barb and the flexible container.

There is also no disclosure of flexible pocket-like container having in combination a retaining strip and detachable fastening means mounted to the wall in the pocket of the flexible container to coact with the clip as called for in the present invention.

The combination retaining strip and detachable fastening means of the present invention permit the clip to be removably mounted to the container so that movement of the container with respect to the wearer is substantially reduced, if not eliminated, thereby permitting the container and wallet to be carried in a more comfortable manner.

There is no disclosure in the known devices of providing the pocket-like container with a central compartment which has a watertight closure thereby permitting use of the wallet in wet environments and preventing ingress of the elements to the central compartment.

OBJECTS AND SUMMARY OF THE INVENTION

To overcome the disadvantages of the known wallet devices, a combination wallet and clip is presented to be removably secured to the clothing in a more comfortable manner.

It is an object of the present invention to provide a clip which can be removed from the wallet so that the wallet can be pocketed in the conventional manner, or removably mounted to the wallet for those occasions where active and vigorous movement of the user is expected.

It is an object of the present invention to provide a clip which is durable and economical to manufacture.

It is another object of the present invention to provide a clip which is easy to manipulate and easy to use with the wallet for attachment to the user's clothing or other items.

It is still another object of the present invention to provide a clip that can hold miscellaneous items disengagingly secured to the clip when the clip is itself secured to the fabric.

It is still another object of the present invention to provide a clip which does not require penetration of the fabric to which it is attached in order to be effectively secured thereto.

It is still another object of the present invention to provide a clip which is formed without any hazardous surface area which could injure the wearer or other persons.

It is still another object of the present invention to provide a clip which allows access to the flexible container without having to remove the container from the clip.

It is still another object of the present invention to provide a container which can be manufactured from a multiplicity of flexible materials, e.g. leather, cloth, polymeric materials, etc.

It is still another object of the present invention to provide a container which can be used with or without the clip.

It is still another object of the present invention to provide a container having a carrying capacity for objects unaffected when the container is used with the clip.

It is still another object of the present invention to provide a container which can be attached to the wearer without requiring the wearer's garments to have a pocket to support the container.

It is still another object of the present invention to provide a container which can be adjustably positioned as desired by the wearer.

It is still another object of the present invention to provide a container which has a waterproof compartment.

To accomplish the objects of the present invention, a clip is provided which is constructed to be removably mounted to a flexible pocket-like container, the clip comprising a back portion which consists of a stabilizing portion near the upper end of the back, and a fastening portion near the lower end of the back; a front portion consisting of a bend and an engagement means, the engagement means disposed at the back side of the bend to face the upper end of the stabilizing portion to resist movement of fabric inserted between the engagement means and the back; and a resilient transition connecting the back portion to the front portion to provide sufficient resilience to urge the bend toward the back portion of the clip for the engagement means to engage fabric disposed between the front portion and the back portion of the clip.

Another embodiment of the present invention includes a flexible pocket-like container with the clip removably mounted thereto, the container comprising a flexible wall, a retaining strip, and a detachable fastening means to retain and detach the clip from the container so that the container can be removably secured to the clip and selectively removed from the clip while the clip remains disengagingly secured to a garment.

In particular, the pouch- or pocket-like container may be a billfold or a wallet.

BRIEF DESCRIPTION OF THE DRAWINGS

For a more complete understanding of the present invention, reference may be had to the following description of exemplary embodiments of the present invention considered in connection with the accompanying drawings, in which.

DETAILED DESCRIPTION OF THE PREFERRED EMBODIMENTS

Figure 1:
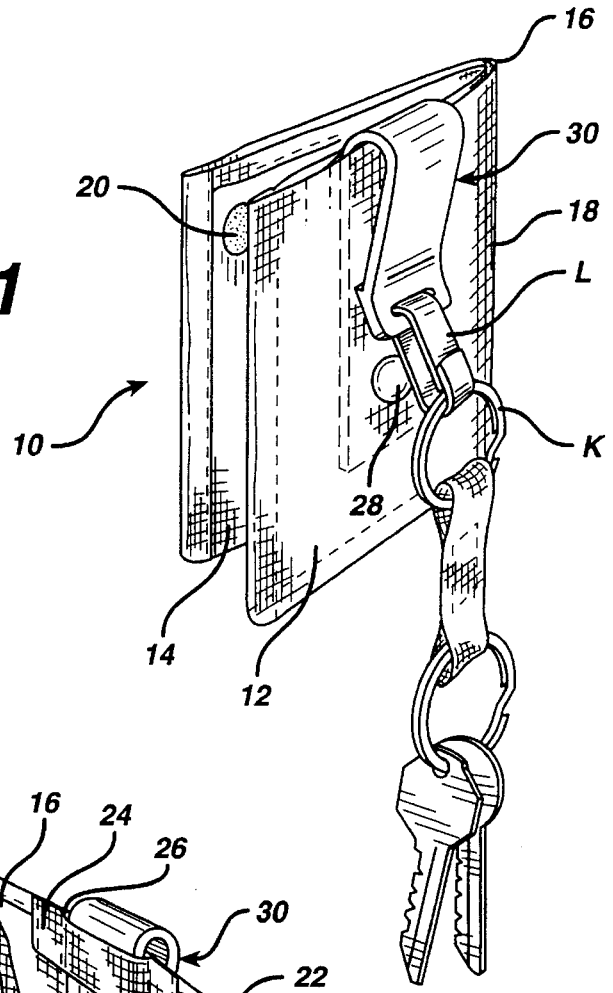
FIG. 1 is a perspective view of a preferred first embodiment of a clip and the container according to the present invention.
Figure 2:
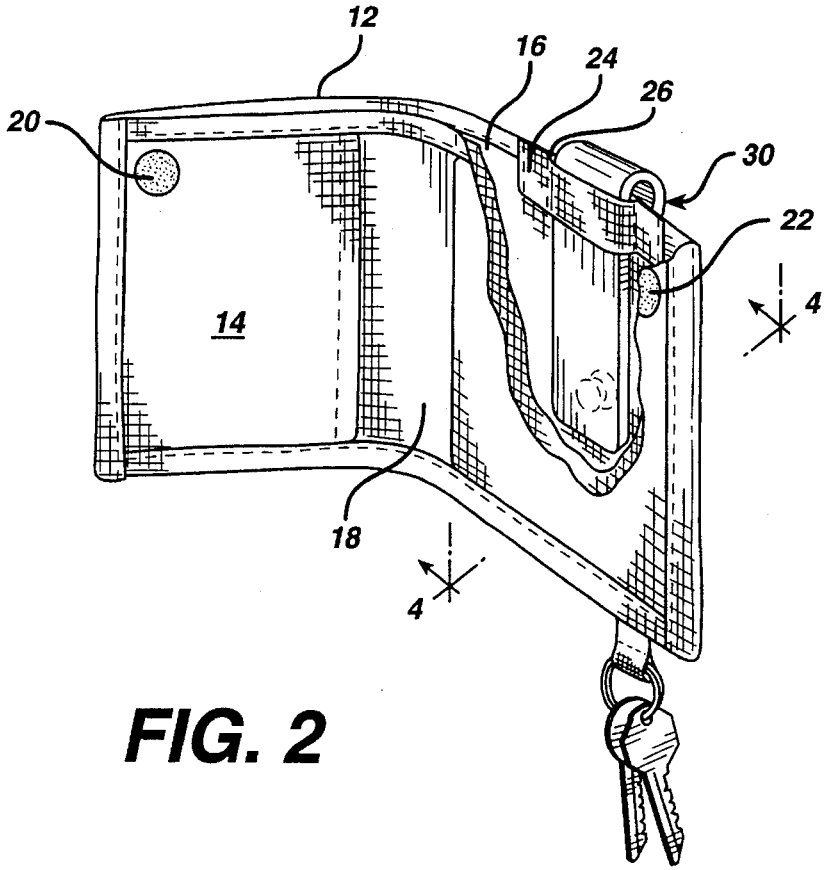
FIG. 2 is a perspective view further showing the clip stabilized and secured to the container according to the present invention.

In FIGS. 1 and 2, the first embodiment of the present invention is shown which consists of a container 10 formed from two panels 12,14 of flexible material secured together along their respective edges by stitching, gluing, etc. to form the walls of the container 10 between which is provided a central compartment 16. The flexible material permits the panels to be bent along a fold line 18 to bring complimentary mating portions 20,22 of hook-and-pile type mating material, such as VELCRO, disposed at opposite sides of the fold line 18 into engaging contact. For perspective with respect to this embodiment, the panel 12 is referred to as the outer wall, while the panel 14 is referred to as the inner wall.

The central compartment 16 of the container 10 is provided with a retaining strip member 24 having opposed end portions secured to the outer wall 12 at the central compartment 16. A portion of the retaining strip 24 intermediate the end portions is unsecured and spaced from the outer wall 12 to provide a space 26 therebetween. The outer wall 12 is also provided with a fastener means 28, such as a snap closure or one of a hook-and-pile material (not shown), at the central compartment 16. The fastener means 28 is disposed below the retaining strip 24 and preferably in registration therewith.

As shown in FIGS. 1 and 2, a clip 30 is provided which is substantially U-shaped for being removably mounted to the container 10 and removably secured to clothing of a wearer (not shown). A portion of the clip 30 is retained and stabilized at the central compartment 16 of the container 10 to facilitate carrying the container 10 on the wearer in a comfortable manner.

A link L is detachably mounted to the clip 30 so that a keychain K, for example, can be detachably secured to the link L to be carried at the exterior of the container 10 or without the container.

Figure 3A:
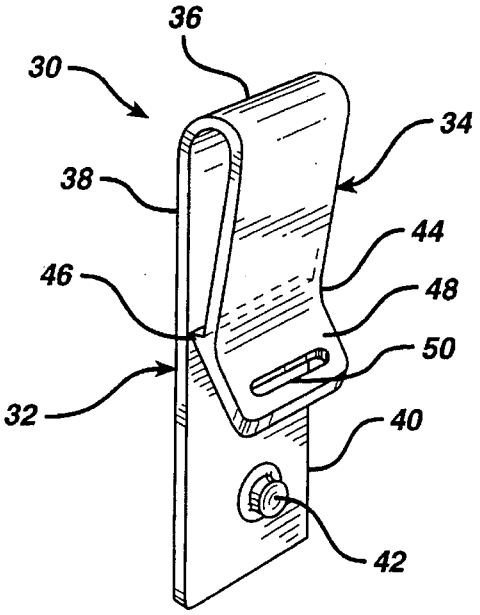
FIG. 3A is a perspective view of the clip for use with the container according to the present invention.

Referring also to FIG. 3A, the clip 10 is shown for use with the container 10 according to the present invention. The clip 30 is provided with a back portion 32, a front portion 34 and a resilient transition portion 36. The back portion 32 is configured for insertion in the space 26 between the strip member 24 and the outer wall 12 of the container 10. The front portion 34 is disposed at the exterior of the outer wall 12 for securing the container 10 to the wearer. The resilient transition portion 36 is configured to provide a transition between the back portion 32 and the front portion 34.

Figure 4A:
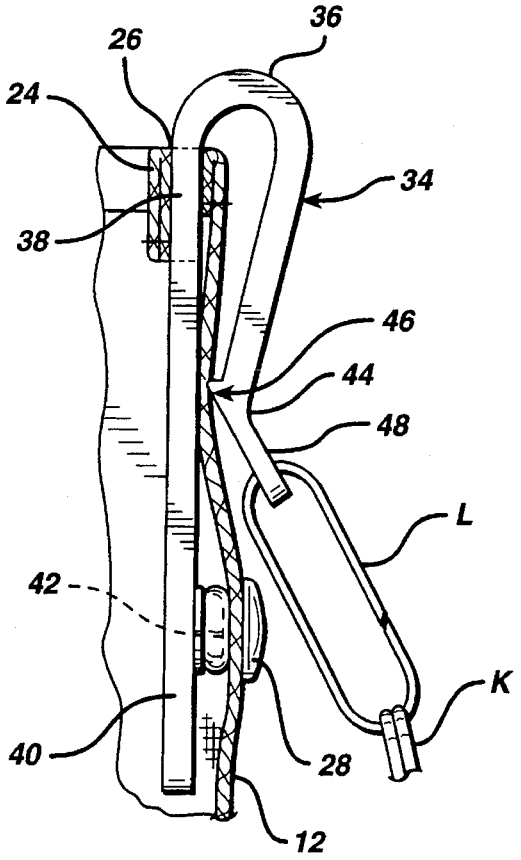
FIG. 4A is a partial broken away elevational view of the container and clip secured thereto taken along line 4—4 in FIG. 2.

Referring also to FIGS. 3A and 4A, the elements and coaction among the elements of the back portion 32, the front portion 34 and the resilient transition portion 36 of the clip 30 are shown.

The back portion 32 of the clip 30 functions as a stabilizer. An upper end 38 is preferably stiff and is disposed in the space 26 provided by the retaining strip 24 to stabilize the clip 30 with respect to the container 10. A lower end 40 of the back portion 32 is provided with a fastening means 42 which is adapted to coact with the fastening member 28 at the central compartment 16 of the container 10. The fastening means 42 is the complimentary portion of a snap closure or another one of the hook-and-pile material used for the fastening member 28. Preferably, the fastening means 42 faces the front portion 34 at the clip 10. In those instances where the fastening means 42 is a snap closure, it is preferred that the snap closure is intricately molded into the back portion 32 so that there is no protruding portion of the snap closure which would extend into the central compartment 16.

The front portion 34 of the clip 30 is formed with a bend 44. A back side of the bend 44 facing the back portion 32 is formed with an engagement means, such as a barb 46. The barb 46 is constructed to engage the outer wall 12 of the container 10, or any other material fabric or object disposed between the barb 46 and the outer wall 12. The barb 46 preferably faces toward the upper end 38 of the back portion 32 to resist movement of any fabric between the upper end 38 and the lower end 40 of the back portion 32. The barb 46 preferably extends completely across the backside of the bend 44. Alternatively, a plurality of separate barbs can extend across the back side of the bend 44.

The bend 44 extends away from the engagement means to a retaining portion 48. The retaining portion 48 is provided with a slot 50 or aperture therethrough to receive other objects such as the detachable link L for a keychain K, pocket watches (not shown), etc.

The resilient transition 36 connects the back portion 32 with the front portion 34 and is of a resiliency sufficient to urge the bend 44 toward the back portion 32 of the clip 30. This resilience forcibly engages material between the barb 46 and the back portion 32 as shown in FIG. 4A.

Figure 3B:
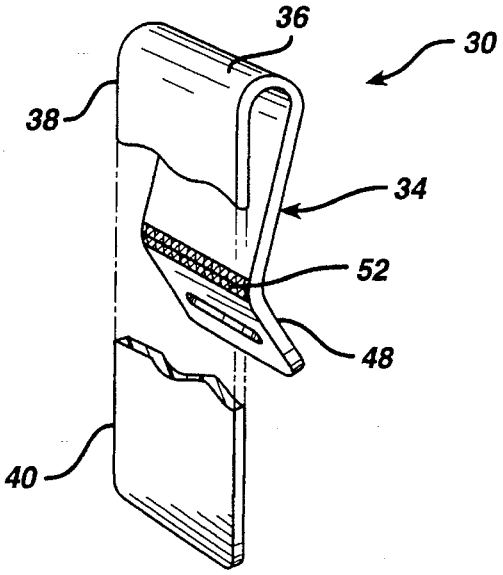
FIG. 3B is a perspective view of another embodiment of the clip for use with the container according to the present invention.

FIG. 3B shows the engagement means of the clip 10 structured as a machined portion 52 at the backside of the bend 44. The machined portion 52 is knurled and extends across the width of the backside of the bend 44 or can be formed across the backside as spaced discrete portions. The machined portion 52 is designed to forcibly engage material between the knurled portion and the back portion 32. Alternatively, the machined portion can be at least one or a plurality of contacting edges at the back side of the bend 44. The contacting edge is preferably formed from at least one pair of ridges arranged perpendicular to the path of travel of the clip 10.

The fastening means 42 of the back portion 32 securely anchors the back portion 32 to the central compartment 16 of the container 10, while the strip member 24 retains and stabilizes the back portion 32 substantially parallel to the fold line 18 of the container 10, thereby substantially reducing, if not eliminating the rocking and pivoting motion associated with vigorous activity when the container 10 is secured to the wearer's clothing. Any movement of the container 10 during vigorous activity corresponds to the movement of the wearer so that the container 10 does not rub or work against the wearer during the activity.

Figure 4B:
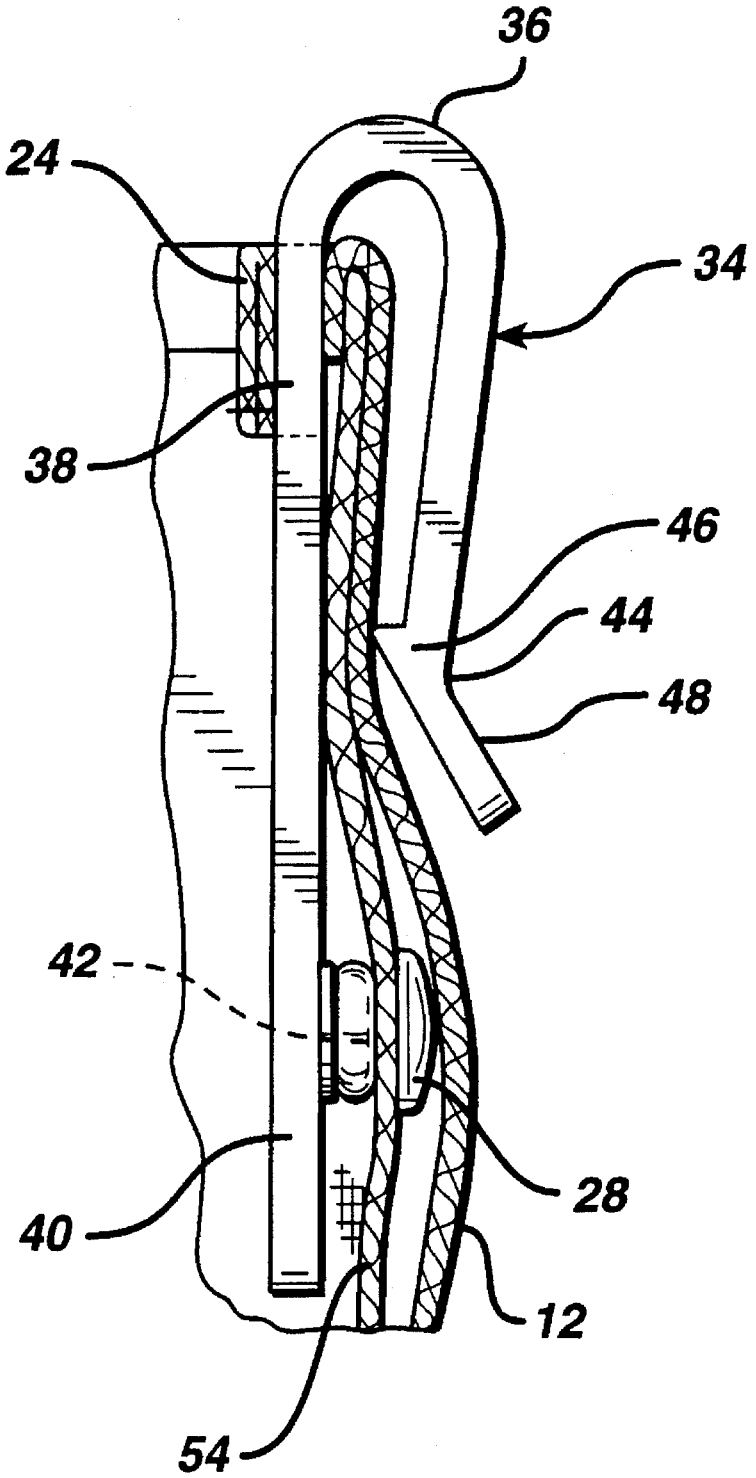
FIG. 4B is a partial broken-away elevational view of the container and clip secured thereto showing another embodiment for removably mounting the clip to the container.

FIG. 4B shows an additional feature which can be added to the container 10 of FIGS. 1, 2 and 4A so that the fastening means 28 is concealed and not viewable from the exterior of the outer wall 12 of the container 10. In FIG. 4B, a panel 54 of flexible material is secured to the outer panel 12 so that the flexible panel 54 extends along the central compartment 16. Instead of the fastening means 28 being secured to the outer panel 12, the fastening means 28 is secured as, for example, a blow-out patch to the flexible panel 54 to disengagingly receive the fastening means 42 of the clip 30. As shown in FIG. 4B, the panel 12 or outer wall conceals the fastening means 28 which presents a more uniform appearance of the container 10. The clip 30 continues to function in the same manner as described with reference to FIG. 4A.

FIGS. 1 and 4A show different types of detachable links L which can be employed to detachably mount the key chain K or the like to the slot 50 of the retaining portion 48.

The clip 30 is preferably formed from a polymeric material, although alloys can also be used.

Alternatively, the panels 12,14 can be constructed from a rigid material, while the retaining strip 24 is constructed from a more flexible material. It is understood, however, that flexible materials for the panels 12,14 are preferred for purposes of comfort.

Three other exemplary embodiments of a combination container 10 and clip 30 constructed in accordance with the present invention are illustrated in FIGS. 5 and 6, 7, and 8, respectively. Elements illustrated in FIGS. 5 and 6, 7 and 8 which correspond to the elements described above with respect to FIGS. 1–4 have been designated by corresponding reference numerals increased by 100, 200 and 300, respectively. The embodiments of the present invention shown in FIGS. 5–8 are for use in the same manner as the embodiment shown in FIGS. 1–4 unless otherwise stated.

Figure 5:
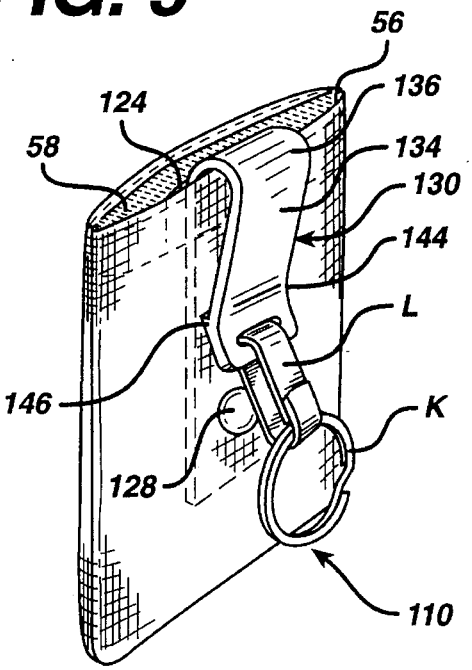
FIG. 5 is a perspective view of a second embodiment of a clip and a container according to the present invention.
Figure 6:
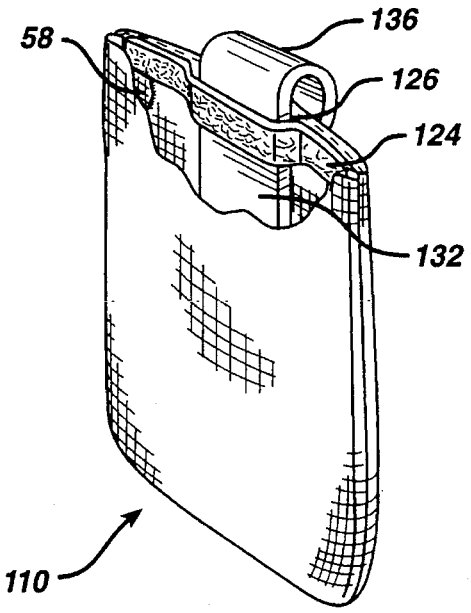
FIG. 6 is another perspective view partially broken away of the clip and container according to the embodiment shown in FIG. 5.

Referring now to FIGS. 5 and 6, a pocket-type container 110 is shown which is formed from a piece of material edge turned and secured to provide a central compartment 116. Alternatively, the container 110 can be formed from two separate flexible panels 112,114 of material joined together along their outer edges to form a sidewall around a central compartment 116. In the second embodiment, a strip member 124 extends; across one side of the opening 56 to the central compartment 116. The strip member 124 is formed from one of a hook and pile type material, such as VELCRO. As shown, opposed end portions of the strip member 124 are secured to the outer wall 112. A portion of the strip member 124 intermediate the end portions is secured to the outer wall 112 to provide a space 126 for the back portion 132 of the clip 130. A mating strip 58 is provided at the opposite side of the opening 56 and is formed of the complimentary one of the hook and pile type material to be releasably engaged to the strip member 124. The use of the hook and pile type material permits controlling access to the central compartment 116 and secures the contents therein.

Figure 7:
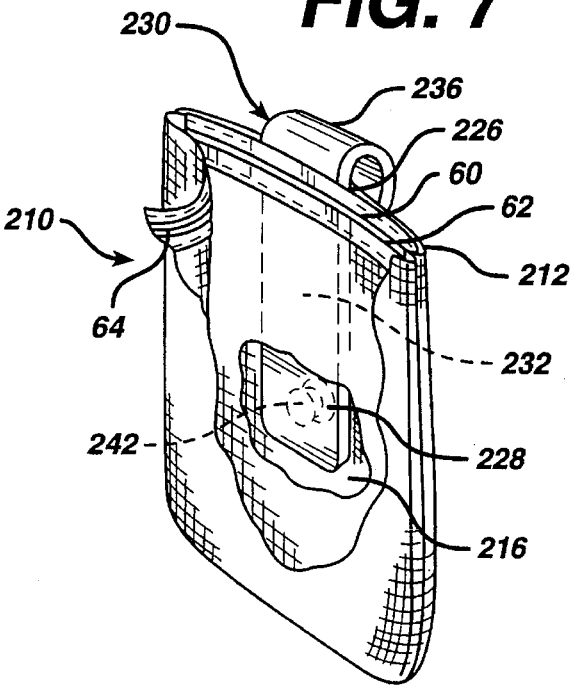
FIG. 7 is a perspective view partially broken away of a third embodiment of the clip and container according to the present invention.

FIG. 7 shows a third embodiment of the container 10 and the clip 30 according to the present invention. In this embodiment, a retaining strip 60 extends substantiality along one side of the central compartment 216. A portion of a retaining strip 60 near the opening 56 of the central compartment 216 is provided with one of a tongue-and-groove fastener 62, while the complimentary engaging portion 64 of the tongue-and-groove fastener is provided at the opposite side of the central compartment 216. Use of the tongue-and-groove fastener is employed to maintain the watertight integrity of the central compartment 216. The retaining strip 60 is spaced from the-panel 212 to form a space 226 in which to receive the back portion 232 of the clip 230. The fastening member 228 is disposed in the space 226 so that the back portion 232 of the clip 230 is not introduced into the central compartment 216 of the container 10, which introduction would compromise the watertight integrity of the central compartment 216.

Figure 8:
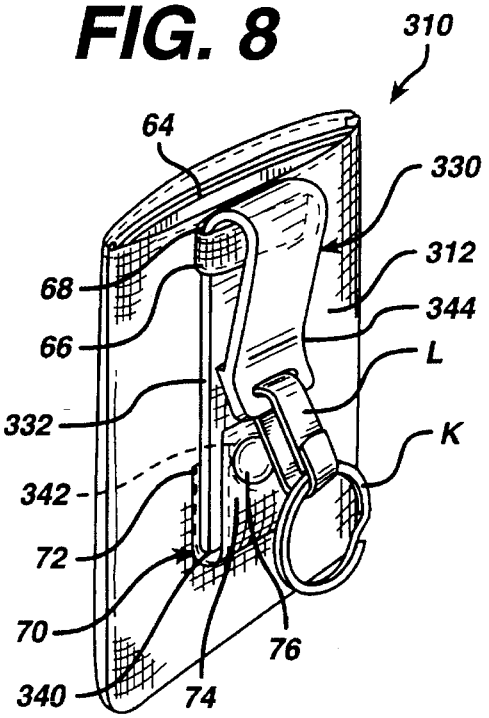
FIG. 8 is a perspective view of a fourth embodiment of the clip and container according to the present invention.

In FIG. 8, the fourth embodiment of the invention is shown. The central compartment 316 can be secured by either the hook-and-pile discussed with reference to FIGS. 5 and 6, or the tongue-and-groove fastener discussed with reference to FIG. 7. In FIG. 8, a retaining strip member 66 is circularly shaped and disposed at the exterior of the panel 312. A portion of the retaining strip member 66 is secured to the panel 312 so that the remaining portion of the strip member 66 provides a space 68 in which to receive the back portion 332 of the clip 330. Another strip 70 is provided below the strip member 68 and has opposed end portions 72,74. The end portion 72 is secured to the exterior of the panel 312, while the end portion 74 hangs free and is provided with a fastening means 76 to be disengagingly fastened to the fastening means 342 of the clip 330. As shown in FIG. 8, the lower end 340 of the back portion 332 is seated between the end portions 72,74 thereby permitting the end portion 74 to be moved upward for the fastening member 342 to be disengagingly fastened to the fastening member 76.

As also shown in PIG. 8, the clip 330 is not provided with the barb 46 or the knurled surface 52, although it can be. However, the bend 344 is of a sufficient angle so that the resilient transition portion 336 of the clip 330 can force the back side of the front portion 34 toward the back portion 332 to resist movement of fabric disposed therebetween during vigorous activity.

The present invention in any of the embodiments discussed with reference to FIGS. 1–8 is durable, easy to manufacture and provides a reliable manner in which to secure a container, such as a wallet, to the wearer's clothing.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What is claimed is:

1. A clip constructed to be removably mounted to a pocket-like container, the clip comprising:

a back portion, the back portion comprising:
a stiff upper end having a stabilizing portion,
a lower end having a snap closure, the snap closure integrally molded to the back portion;

a front portion, the front portion comprising:
a bend,
a barb, the barb formed at a backside of the bend and facing the upper end of the stabilizing portion to resist movement of material from the upper end of the stabilizing portion to the lower end of the back portion,
retaining means, the retaining means extending from the bend in a direction away from the back portion, and having an aperture formed therethrough for releasably receiving other objects; and a resilient transition, the resilient transition connecting the back portion with the front portion and providing sufficient resilience to urge the bend portion toward the back portion for the barb to engage the material disposed between the back portion and the barb.

2. A clip constructed to be removably mounted to a pocket-like container, the clip comprising:

a back portion, the back portion comprising:
an upper end having a stabilizing portion,
a lower end having a fastening portion;

a front portion, the front portion comprising:

a bend, engagement means formed at a backside of the bend and facing the back portion,
retaining means, the retaining means extending from the bend and having an aperture formed therethrough for releasably receiving other objects,
wherein the engagement means includes at least one contacting edge of at least one pair of ridges disposed at the backside of the bend to resist movement of material from the upper end of the stabilizing portion to the lower end of the back portion; and a resilient transition, connecting the back portion with the front portion and providing sufficient resilience to urge the bend portion toward the back portion for the engagement means to engage material disposed between the back portion and the engagement means.

3. The clip according to claim 2, wherein the upper end of the stabilizing portion is stiff.

4. The clip according to claim 2, wherein the fastening portion faces the engagement means.

5. The clip according to claim 2, wherein the fastening portion is a snap closure.

6. The clip according to claim 5, wherein the snap closure is integrally molded into the back portion.

7. The clip according to claim 2, wherein the fastening portion is one of a hook and pile type material.

8. The clip according to claim 7, wherein the one of a hook and pile type material is permanently fixed to the lower end of the fastening portion to face the bend.

9. The clip according to claim 1, wherein the engagement means is a barb.

10. The clip according to claim 9, wherein the barb is configured to face the upper end of the stabilizing portion.

11. The clip according to claim 2, wherein the engagement means comprises:

a plurality of barbs disposed at spaced intervals across a width of the backside of the bend.

12. The clip according to claim 2, wherein the engagement means is a knurled portion formed in the backside of the bend of the front portion.

13. The clip according to claim 2, wherein the engagement means comprises:

a plurality of knurled portions disposed at spaced intervals across a width of the backside of the bend.

14. The clip according to claim 2, wherein the retaining means extends from the bend in a direction away from the back portion.

15. A pocket-like container with a clip removably mounted thereto, comprising:

a flexible wall;

a central compartment surrounded by the flexible wall and extending to an opening;

a retaining strip mounted to the wall in the central compartment, a portion of the retaining strip spaced from the wall;

a snap closure mounted to the flexible wall in the central compartment below the retaining strip;

a clip comprising:
a back portion, the back portion comprising:
a stiff upper end having a stabilizing portion,
a lower end having a complimentary snap closure, the complimentary snap closure integrally molded to the back portion;

a front portion, the front portion comprising:

a bend, a barb formed at a backside of the bend and facing the upper end of the stabilizing portion to resist movement of material from the upper end of the stabilizing portion to the lower end of the back portion, retaining means extending from the bend in a direction away from the back portion, and having an aperture formed therethrough for releasably receiving other objects; and a resilient transition connecting the back portion with the front portion and providing sufficient resilience to urge the bend portion toward the back portion for the barb to engage the material disposed between the back portion and the barb, wherein the stabilizing portion of the clip is disposed in the space between the flexible wall and the retaining strip, the snap closure coacts with the complimentary snap closure of the back portion of the clip to removably secure the clip to the flexible wall, the bend at the front portion of the clip held in tension toward the flexible wall.

16. A pocket-like container with a clip removably mounted thereto, comprising:

a wall:

a central compartment surrounded by the wall and extending to an opening;

a retaining strip mounted to the wall in the central compartment, a portion of the retaining strip spaced from the wall;

fastening means mounted to the wall in the central compartment below the retaining strip;

a clip constructed to be removably mounted to the pocket-like container, the clip comprising:

a back portion, the back portion comprising:

an upper end with a stabilizing portion, a lower end with a complimentary fastening means;

a front portion, the front portion comprising:

a bend, engagement means formed at a backside of the bend and facing the back portion to resist movement of material from the upper end of the back portion to the lower end of the back portion, retaining means extending from the bend and having an aperture formed therethrough for releasably receiving other objects;

a resilient transition connecting the back portion with the front portion to provide sufficient resilience to urge the bend portion toward the back portion for the engagement means to engage material disposed between the back portion and the engagement means, wherein the stabilizing portion of the clip is disposed in the space between the wall and the retaining strip, the fastening means coacts with the complimentary fastening means of the back portion of the clip to removably secure the clip to the wall, the bend at the front portion of the clip held in tension contact with the wall.

17. The pocket-like container with a clip according to claim 16, wherein the upper end of the stabilizing portion is stiff.

18. The pocket-like container with a clip according to claim 16, wherein the complimentary fastening means faces the engagement means.

19. The pocket-like container with a clip according to claim 16, wherein the fastening means is a snap closure and the complimentary fastening means is a complimentary snap closure.

20. The pocket-like container with a clip according to claim 19, wherein the complimentary snap closure is integrally molded into the back portion.

21. The pocket-like container with a clip according to claim 16, wherein the complimentary fastening means is one of a hook and pile type material.

22. The pocket-like container with a clip according to claim 21, wherein the one of a hook and pile type material is permanently fixed to the lower end of the back portion to face the bend.

23. The pocket-like container with a clip according to claim 16, wherein the engagement means is a barb.

24. The pocket-like container with a clip according to claim 23, wherein the barb is configured to face the upper end of the stabilizing portion.

25. The pocket-like container with a clip according to claim 16, wherein the engagement means comprises a plurality of barbs disposed at spaced intervals across a width of the backside of the bend.

26. The pocket-like container with a clip according to claim 16, wherein the engagement means is a knurled portion disposed in the backside of the bend of the front portion.

27. The pocket-like container with a clip according to claim 16, wherein the engagement means comprises a plurality of knurled portions disposed at spaced intervals across a width of the backside of the bend.

28. The pocket-like container with a clip according to claim 16, wherein the retaining means extends from the bend in a direction away from the pocket-like container.

29. The pocket-like container with a clip according to claim 16, further comprising:

a closure strip mounted in the central compartment for releasable engagement with the retaining strip to control access through the opening at the central compartment.

30. The pocket-like container with a clip according to claim 29, wherein the closure strip and the retaining strip are provided with complimentary hook and pile type fastener material for releasable engagement to each other.

31. The pocket-like container with a clip according to claim 16, further comprising:

a material panel disposed in the central compartment along an interior of the wall, the fastening means mounted to the material panel, wherein the fastening means is concealed from view when the pocket-like container is viewed from an exterior of the wall.

32. The pocket-like container with a clip according to claim 16, wherein the pocket-like container is a wallet.

33. The pocket-like container with a clip according to claim 16, wherein the wall is flexible.

34. The pocket-like container with a clip according to claim 33, further comprising:

a fold line along which the flexible wall can be folded substantially into two halves.

* * * * *